United States Patent [19]

Fournier

[11] Patent Number: 4,746,010

[45] Date of Patent: May 24, 1988

[54] BOX CONVERTIBLE TO FOOD ITEM TRAY

[76] Inventor: Stephen Fournier, 74 Tremont St., Hartford, Conn. 06105

[21] Appl. No.: 880,141

[22] Filed: Jun. 30, 1986

[51] Int. Cl.[4] ..... B65D 5/00; B65D 5/54

[52] U.S. Cl. ..... 206/45.14; 206/602; 206/627; 229/DIG. 13; 211/13

[58] Field of Search ..... 211/13, 70.1; 229/DIG. 13; 206/45.14, 541, 602, 627; 248/174, 152; 426/132

[56] References Cited

U.S. PATENT DOCUMENTS

| | | | |
|---|---|---|---|
| D. 266,816 | 11/1982 | Schupp | D7/27 |
| D. 267,143 | 12/1982 | Gessing et al. | D7/72 |
| 2,027,747 | 1/1936 | Morton | 229/48 R |
| 2,313,391 | 9/1938 | Schraffenberger | 206/602 |
| 2,888,132 | 5/1959 | Guyer | 206/627 |
| 2,967,610 | 1/1961 | Ebert et al. | 206/602 |
| 3,637,130 | 1/1972 | Farqukar | 229/8 |
| 4,362,247 | 12/1982 | Rueda | 211/13 |
| 4,573,570 | 3/1986 | Cortopassi | 229/DIG. 13 |
| 4,573,579 | 3/1986 | Murdick et al. | 229/DIG. 13 |
| 4,589,619 | 5/1986 | Forbes, Jr. | 248/174 |
| 4,603,825 | 8/1986 | Kotliar | 229/DIG. 13 |

*Primary Examiner*—Stephen Marcus
*Assistant Examiner*—T. Graveline
*Attorney, Agent, or Firm*—CTC & Associates

[57] ABSTRACT

A box of card stock for packaging a predetermined number of food items, such as taco shells and related filling materials, is convertible by the consumer into a tray for holding at least one such food item after preparation and carrying same from stove to table. The box has perforated score line means along which portions of the box are separable from each other to produce the tray, exposing at least one recess shaped to hold the prepared item. The tray has a base that cooperates with the recess to hold the prepared item in a stable upright position.

1 Claim, 3 Drawing Sheets

BOX CONVERTIBLE TO FOOD ITEM TRAY

BACKGROUND OF THE INVENTION

This invention relates to boxes of card stock for packaging food items, such as taco shells and related filling materials, which boxes are convertible by the consumer into trays for carrying filled tacos from stove to table.

A novelty search hereon revealed the following U.S. Patents:

| | U.S. Pat. No. | Date | Inventor |
|---|---|---|---|
| | 3,332,340 | July 25, 1967 | Wirtz et al. |
| | 4,196,807 | April 8, 1980 | Brom |
| | 4,270,660 | June 2, 1981 | Putt |
| | 4,512,512 | April 23, 1985 | Fleming |
| | 4,535,891 | August 20, 1985 | Murdick et al. |
| Des. | 263,191 | March 2, 1982 | Moore |
| Des. | 263,786 | April 13, 1982 | Kohan |
| Des. | 266,816 | November 9, 1982 | Schupp |
| Des. | 267,143 | December 7, 1982 | Gessing et al. |
| Des. | 273,746 | May 8, 1984 | Hunt |
| Des. | 279,160 | June 11, 1985 | Hunt |

Several of these eleven patents disclose devices specifically for holding tacos, but only two of the eleven patents disclose food carriers formed of card stock. These are the patents to Brom and Fleming, neither of which relates to a taco holder. The patents to Brom disclose a cup carrier of card stock, held together by glue strips or staples. The patent to Fleming discloses a fast food serving tray of card stock, in which connecting tabs at the ends of the tray are adhesively held together.

The patents to Murdick et. al. is typical of the patents relating to taco trays. This tray is, however, made by molding or die forming.

To summarize, the eleven patents do not disclose a card stock box for packaging food items, such as taco shells and related filling materials, which box is convertible by the consumer into a tray for carrying filled tacos from stove to table.

It is an important object of the invention to provide a card stock box for packaging food items, such as taco shells and related filling materials, which box is convertible by the consumer into a tray for carrying filled tacos form stove to table.

It is another object to provide such a box that can be produced by a simple modification of an existing box now in use for packaging taco shells.

It is a further object to provide such a modified box produced by the addition of perforated score lines to such an existing box, such that the modified box can be produced at little, if any, increase in cost.

It is an additional object to provide such a modified box that is disposable.

The foregoing and other objects and advantages will appear hereinafter.

SUMMARY OF THE INVENTION

A box according to the invention is made of card stock and may be a modification of an existing box that is used to package food items, such as taco shells and related filling materials. The box is convertible into a tray for holding at least one such food item after preparation and carrying the same from stove to table. The card stock has perforated score line means along which portions of the box are separable from each other to produce the tray, exposing at least one recess sized and shaped to hold the prepared item. The tray also has a rectangular base that is either closed or open. If the base is closed, it may be provided by an original panel of the box. If it is open, it may be provided by the same score line means or additional perforated score line means extending completely around the box. The base cooperates with the recess to hold the prepared item in a stable upright position.

DESCRIPTION OF THE INVENTION

Figure 1:
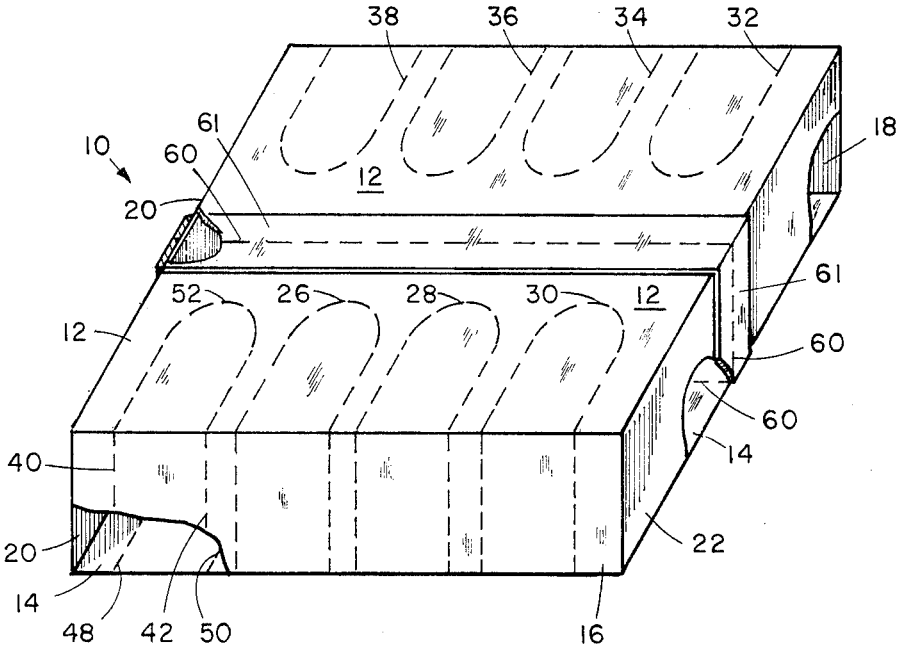
FIG. 1 is a perspective view, partly broken away, of a first preferred box in accordance with the invention.

FIG. 1 is a perspective view of a first box 10 in accordance with the invention. Box 10 is fabricated of card stock and is in the form of a rectangular solid, having parallel rectangular top and bottom panels 12 and 14, respectively, parallel rectangular front and back panels 16 and 18, respectively, and parallel rectangular left and right end panels 20 and 22, respectively.

Box 10 is the package for a plurality of food items, such as taco shells and perhaps related filling materials for the taco shells. Taco shells are widely available packaged twelve in a box. Such a box measures about 1.875 inches (4.8 cm) between panels 12 and 14, 5.75 inches (14.6 cm) between panels 16 and 18 and 7.25 inches (18.4 cm) between panels 20 and 22, and has a zip open means (not shown) along one of panels 20 and 22 for opening box 10.

Box 10 is provided with score line means including a plurality, eight as shown, of closed recess-producing perforated score lines along which portions of box 10 are separable from each other. Specifically, box 10 has eight closed recess producing score lines 24, 26, 28, 30, 32, 34, 36 and 38. Each of score lines 24, 26, 28 and 30 lies in panels 12, 14 and 16, while each of score lines 32, 34, 36 and 38 lies in panels 12, 14 and 18.

Since score lines 24, 26, 28, 30, 32, 34, 36 and 38 are identical, only one needs to be described in detail. The one chosen for description is score line 24.

Score line 24 has straight parallel portions 40 and 42 in panel 16, perpendicular to panels 12 and 14 and extending from panel 12 to panel 14. Score line 24 further has straight parallel portions 44 and 46 in panel 12, perpendicular to panel 16 and forming continuations of portions 40 and 42, respectively, and straight parallel portions 48 and 50 in panel 14, perpendicular to panel 16 and forming continuations of portions 40 and 42, respectively. Portions 44 and 46 are joined by an arcuate portion 52 in panel 12 and centered midway between portions 44 and 46 and tangential thereto. The distance from panel 16 to the part of arcuate portion 52 that is farthest from panel 16 is about 1.875 inches (4.8 cm). Portions 48 and 50 are likewise joined by an arcuate portion (not visible) in panel 14 and centered midway between portions 48 and 50 and tangential thereto. The distance from panel 16 to the part of the last mentioned arcuate portion that is farthest from panel 16 is about 1.875 inches (4.8 cm).

The distance between portions 44 and 46 is about 1.25 inches (3.0 cm).

Score line 24 is spaced about 0.5625 inch (1.4 cm) from panel 20 and about 0.375 inch (1.0 cm) from score line 26.

Score line 28 is spaced about 0.375 inch (1.0 cm) from score line 26, and score line 30 is spaced about 0.375 inch (1.0 cm) from score line 28 and about 0.5625 inch (1.4 cm) from panel 22.

Figure 2:
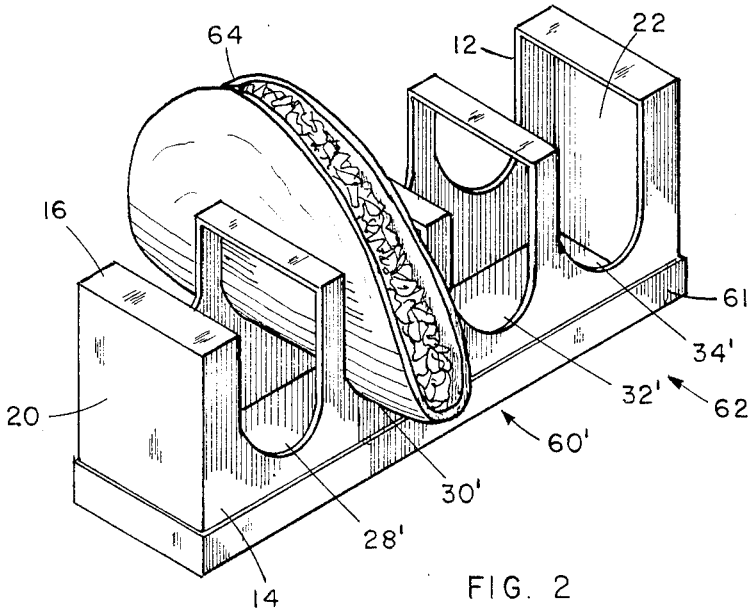
FIG. 2 is a perspective view of a tray into which the box of FIG. 1 has been converted, the tray shown holding a filled taco.

Box 10 is also provided with additional score line means including a closed score line 60 lying in the plane parallel to and midway between panels 16 and 18, about 2.875 inches (7.2 cm) from each. Score line 60 is in and bisects panels 12, 14, 20 and 22, thus extending all the way around box 10. Box 10 may advantageously be reinforced adjacent to line 60, as indicated at 61, for stability Portions of box 10 are separable from each other by the consumer to convert box 10 into a tray 62 (FIG. 2) having taco holding recesses and a base. More specifically, the card stock within each of score lines 24, 26, 28, and 30 is removed to expose taco holding recesses 28', 30', 32', and 34', respectively. As shown in FIG. 2, these recesses have rounded bottoms and parallel sides in panels 12 and 14.

The conversion of box 10 into tray 62 is completed by separating the card stock along base-producing score line 60 to provide tray 62 with an open base 60', on which tray 62 can be stored on a flat surface with taco holding recesses 28', 30', 32', and 34' facing upwardly.

As shown in FIG. 2, a filled taco 64 can be held in a stable upright position. Taco 64 is shown in recess 30'.

Box 10 can be made to yield a second tray identical to tray 62 by removing the card stock within score lines 32, 34, 36, and 38.

It is stated above that box 10 typically provides twelve taco shells and possibly related filling material. The two trays into which box 10 is convertible can handle eight filled tacos. One of those trays can be reused to the extent of handling four additional filled tacos before disposal.

Figure 3:
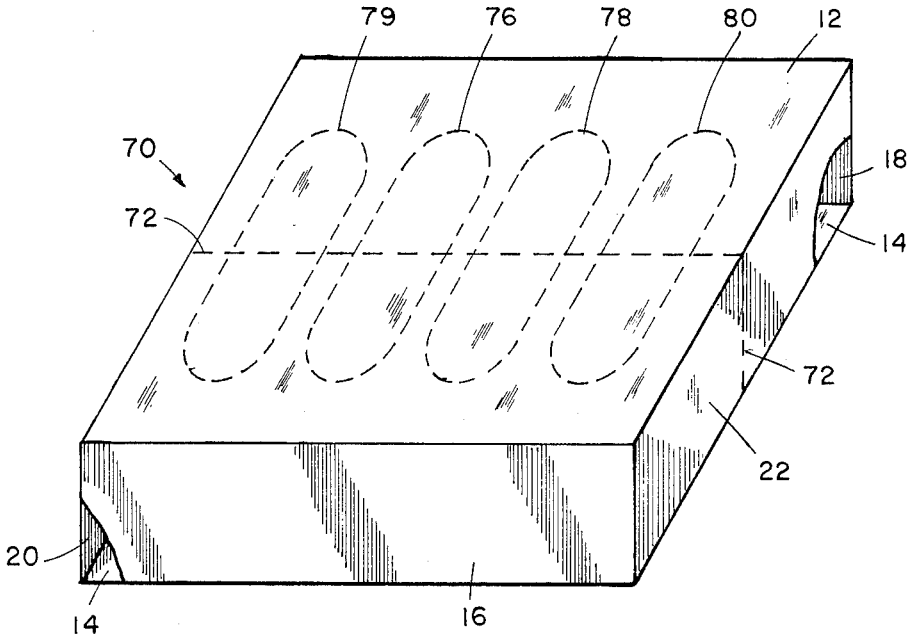
FIG. 3 is a perspective view, partly broken away, of a second preferred box in accordance with the invention.

FIG. 3 is a perspective view of a second box 70 in accordance with the invention. Box 70 may be the same as box 10 in size and shape, having top and bottom panels 12 and 14, respectively, front and back panels 16 and 18, respectively, and left and right panels 20 and 22, respectively.

Box 70, like box 10, also has additional score line means including a score line 72 extending therearound, similar to base producing score line 60 of box 10. But score line 72 is not a base producing score line, as will appear more clearly.

Box 70 also has, in top panel 12, a plurality, four as shown, of like closed recess-producing perforated score lines 79, 76, 78, and 80 that traverse and are bisected by line 72. Socre lines 79, 76, 78, and 80 are elongated with arcuate ends remote from line 72. Box 70 further has, in bottom panel 14, four closed recess-producing perforated score lines (not shown), sized and shaped the same as lines 79, 76, 78, and 80, and directly in registry with lines 74, 76, 78 and 80.

Box 70 is convertible into a tray 82 (FIG. 4) by separating box 70 along line 72 and thereupon removing the card stock within lines 79, 76, 78, and 80 and the lines directly in registry therewith in panel 14, thus to expose four taco holding recesses 74', 76', 78', and 80', filled taco 64 being shown in recess 76'.

Panel 16 provides a closed base for box 82.

The foregoing procedure also creates out of box 70 a second tray identical to tray 82, but with the base being provided by panel 18.

Figure 4:
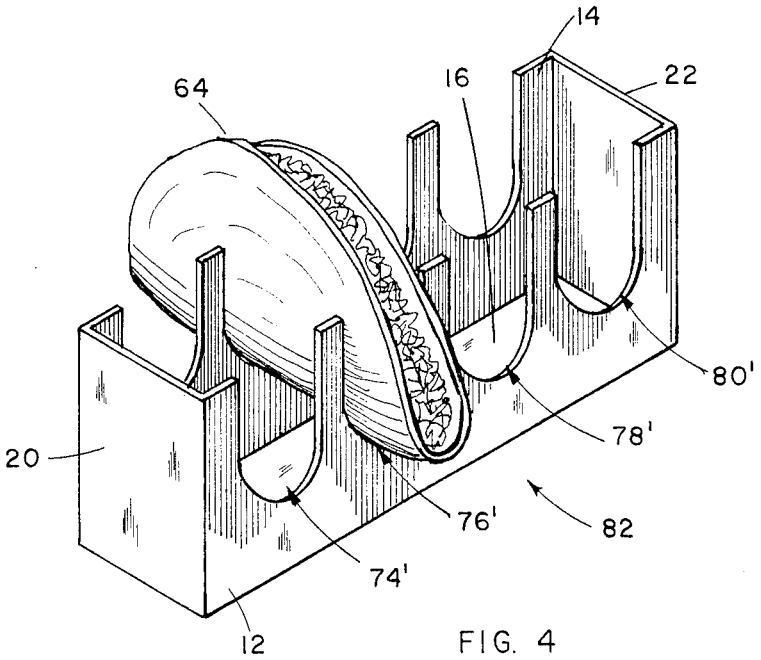
FIG. 4 is a perspective view of a tray into which the box of FIG. 3 has been converted, the tray shown holding a filled taco.
Figure 5:
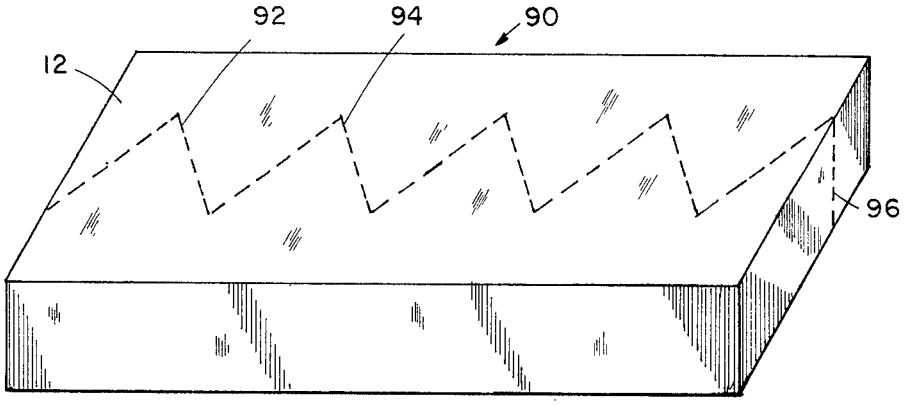
FIG. 5 is a perspective view, partly broken away, of a third preferred box in accordance with the invention.

FIG. 4 is a perspective view of a third box 90 in accordance with the invention. Box 90 may be the same size and shape as box 10. Box 90 has score line means including a single perforated score line 92 extending therearound. Line 92 follows a zig-zag course 94 across one panel of box 90 and a zigzag course (not seen) in registry with course 94 across an opposite panel of box 90. Line 92 follows a straight course 96 across a further panel from one end of the unseen zig-zag course and a straight course (not seen) along the panel opposite the further panel and joining the opposite ends of course 94 and the unseen zig-zag course.

Figure 6:
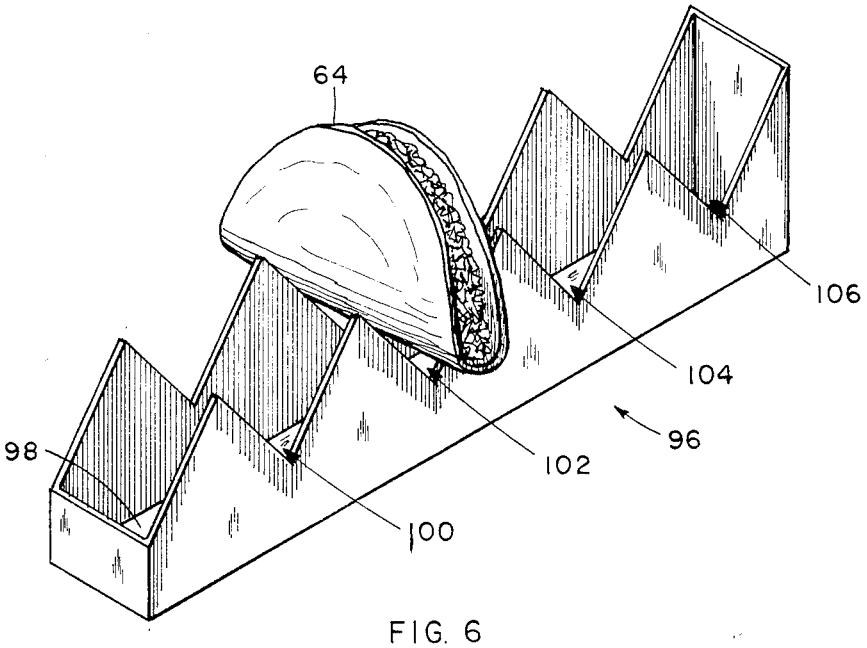
FIG. 6 is a perspective view of a tray with which the box of FIG. 5 has been converted, the tray shown holding a filled taco.

Box 90 is convertible into two trays 96 (FIG. 6) by separating the two halves of box 90 along line 92. Each tray 96 has a closed base 98 provided by one of the panels of box 90 and four upwardly facing V-shaped taco holding recesses 100, 102, 104 an 106, filled taco 64 being shown in recess 102.

It is apparent that the invention achieves the stated objects and advantages and others.

The disclosed details are exemplary and are not to be taken as limitations on the invention except as those details may be included in the appended claims.

What is claimed is:

1. A box of card stock for packaging a predetermined plural number of food items, said box convertible into two identical trays, each for holding at least one said food item after preparation, said box having recess producing score line means along which portions of said box are separable from each other to produce the trays, each having at least one exposed recess for holding a said prepared item, said box being in the form of a rectangular solid having parallel rectangular top and bottom panels, parallel rectangular front and back panels and parallel rectangular left and right end panels and said box including additional score line means including an additional score line defining a plane parallel to said front and back panels and bisecting said left and right end panels and said top and bottom panels and extending completely around said box in said end panels and said top and bottom panels, said box being separable along said additional score line into two like portions, and said recess producing score line means including a first closed score line having parallel side portions in said front panel parallel to said end panels, parallel side portions in said top and bottom panels parallel to said end panels and forming continuations of said parallel portions in said front panel, and arcuate portions in said top and bottom panels joining said parallel portions, said first score line located entirely on one side of said additional score line, and said recess producing score line means further includes a second closed score line having parallel side portions in said back panel parallel to said end panels, parallel side portions in said top and bottom panels parallel to said end panels and forming continuations of side parallel portions in said back panel, and arcuate portions in said top and bottom panels parallel to said end panels and forming continuations of said parallel portions in said top and bottom panels joining said parallel portions, said second score line located entirely on the other side of said additional score line, whereby separation of said box along said additional score line provides each of said two trays with an open base and removal of the card stock from within said first closed score line provides one of said two trays with a food article holding recess and removal of card stock from within said second closed score line provides the other of said two trays with a food article holding recess.

* * * * *